US007891600B1

(12) United States Patent
Schmatz

(10) Patent No.: US 7,891,600 B1
(45) **Date of Patent: *Feb. 22, 2011**

(54) TOILET PAPER HOLDER REMOVAL SYSTEM AND METHOD

(76) Inventor: John M. Schmatz, 516 Harmony La. SW., Hutchinson, MN (US) 55350

( * ) Notice: Subject to any disclaimer, the term of this patent is extended or adjusted under 35 U.S.C. 154(b) by 0 days.

This patent is subject to a terminal disclaimer.

(21) Appl. No.: 12/038,065

(22) Filed: Feb. 27, 2008

(51) Int. Cl.
*B65H 75/18* (2006.01)

(52) U.S. Cl. ..... 242/598.3; 242/599.1

(58) Field of Classification Search ..... 242/598.2, 242/598.3, 598.6, 599.1, 599.3, 423.1
See application file for complete search history.

(56) References Cited

U.S. PATENT DOCUMENTS

| | | | | |
|---|---|---|---|---|
| 1,259,313 | A | 3/1918 | Sturgis | |
| 1,665,739 | A | 4/1928 | Hoegger | |
| 2,253,664 | A * | 8/1941 | Vigo | 242/599.1 |
| 2,522,109 | A * | 9/1950 | Foltis | 242/599.3 |
| 3,037,718 | A | 6/1962 | Pettit | |
| 3,239,158 | A * | 3/1966 | Levesque | 242/599.1 |
| D296,963 | S | 8/1988 | Smallwood | |
| 6,092,760 | A | 7/2000 | Hedrick | |
| 6,412,726 | B2 | 7/2002 | Inana et al. | |
| 6,431,493 | B1 * | 8/2002 | Stauner | 242/598.3 |
| 6,572,051 | B1 * | 6/2003 | Stude | 242/598.2 |
| 7,213,783 | B1 | 5/2007 | Schmatz | |

* cited by examiner

*Primary Examiner*—William A Rivera

(57) ABSTRACT

A toilet paper holder removal system includes a toilet paper holder configured for holding a toilet paper roll and dispensing toilet paper from the toilet paper roll. The toilet paper holder includes a pair of brackets each having a well extending therein. A cylinder has a first end and a second end and includes a first portion slidably extendable into a second portion. The first end is biased away from the second end. Each of a pair of nubs is attached to and extends outwardly away from one of the first and second ends. Each of the nubs is removably extended into one of the wells. A grip is provided and is configured to be removably positioned on one of the nubs. The grip may be used to provide leverage when the first end of the cylinder is urged toward the second end of the cylinder.

6 Claims, 3 Drawing Sheets

TOILET PAPER HOLDER REMOVAL SYSTEM AND METHOD

BACKGROUND OF THE INVENTION

1. Field of the Invention

The present invention relates to toilet paper holder removal devices and more particularly pertains to a new toilet paper holder removal device for assisting someone in removing a cylinder from a pair of brackets so that the leverage may more easily be exerted on the cylinder.

2. Description of the Prior Art

The use of toilet paper holder removal devices is known in the prior art. U.S. Pat. No. 3,037,718 describes a device for assisting a person in removing a toilet paper holder from its mounting. Another type of toilet paper holder removal device is U.S. Pat. No. 6,412,726 having a means for inserting and removing a roll of toilet paper from a toilet paper housing. Still another such device is found in U.S. Pat. No. 1,259,313.

While these devices fulfill their respective, particular objectives and requirements, the need remains for a device that may be easily retrofitted to existing toilet paper holders to add a person in mounting or removing a toilet paper roll from mounting brackets.

SUMMARY OF THE INVENTION

The present invention meets the needs presented above by generally comprising a toilet paper holder configured for holding a toilet paper roll and dispensing toilet paper from the toilet paper roll. The toilet paper holder includes a pair of brackets that are spaced from each other. The brackets each have a well extending therein which face each other and are axially aligned with each other. A cylinder has a first end and a second end. The cylinder includes a first portion slidably extendable into a second portion. A distance between the first and second ends may be selectively altered. The first end is biased away from the second end. A first nub and a second nub are provided. The first nub is attached to the first end of the sleeve and the second nub is attached to the second end of the sleeve. The first and second nubs extend outwardly away from an associated one of the first and second ends. Each of the first and second nubs is removably extended into one of the wells and mounts the cylinder to the brackets. A single grip is removably positioned on the first nub to provide leverage when the first end of the cylinder is urged toward the second end of the cylinder. The grip includes a panel that has a first end and a second end. A loop is attached to the first end of the grip. The first nub is extended through the loop to mount the grip on the on the cylinder. The panel is be used to urge the first end of the cylinder toward the second end of the cylinder when the first and second nubs are is positioned in or removed from the wells.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
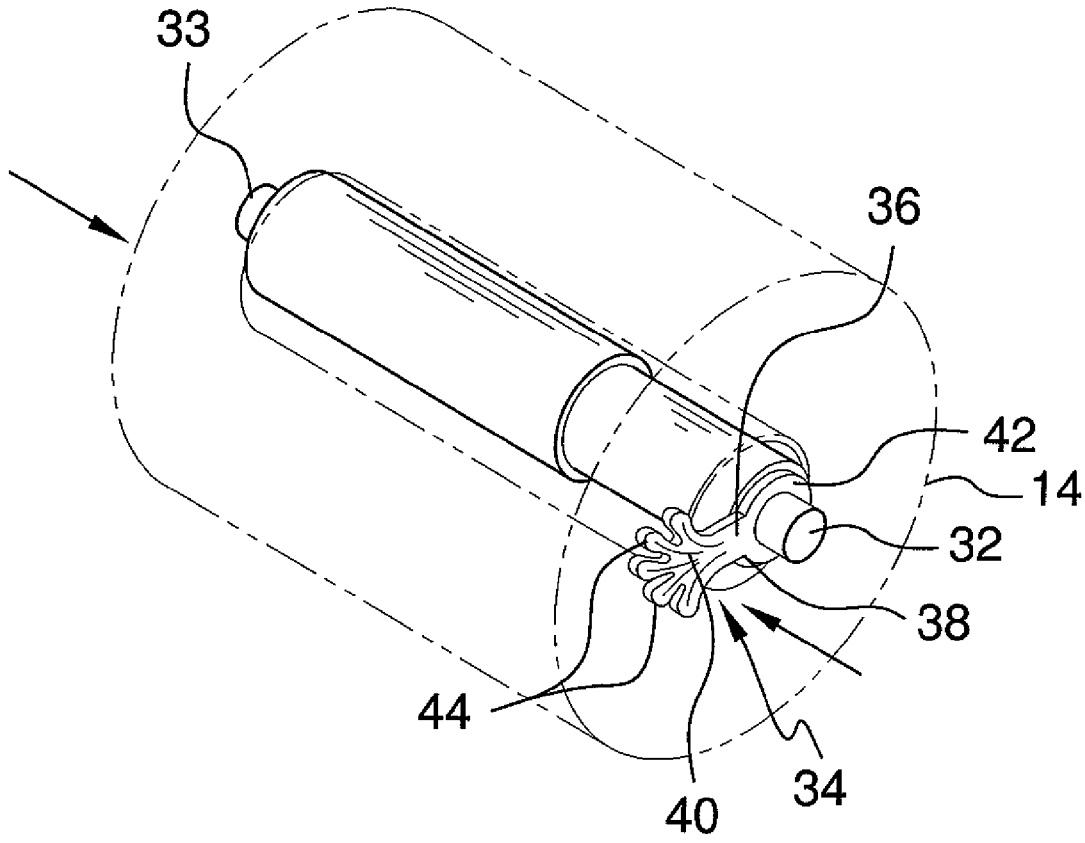
FIG. 1 is a perspective view of a toilet paper holder removal system and method according to the present invention.
Figure 2:
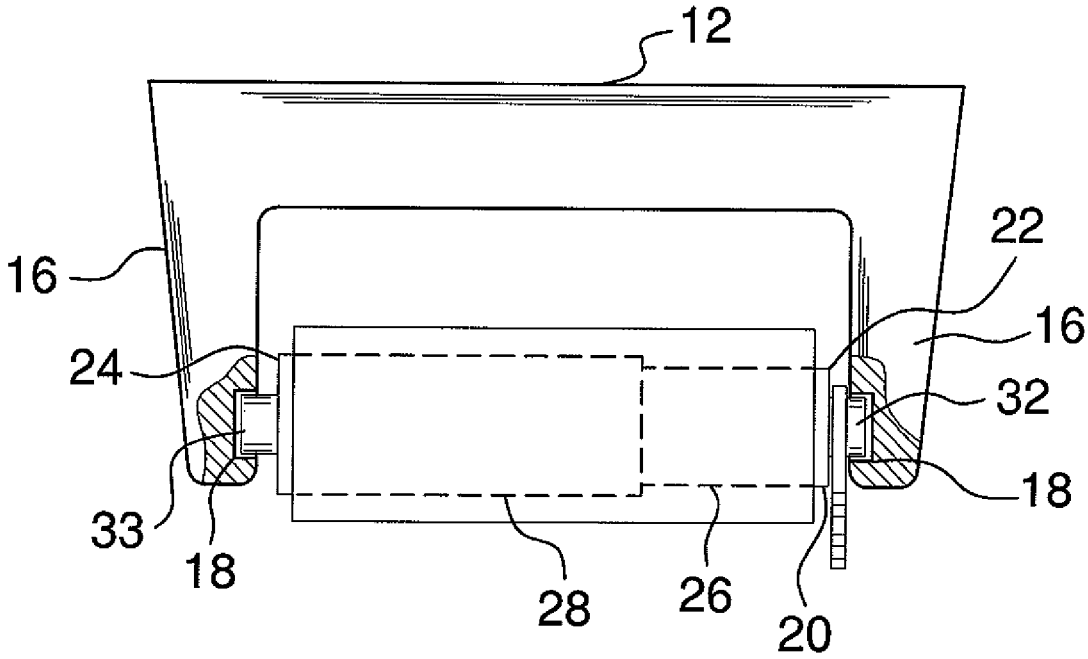
FIG. 2 is a top view of the present invention.
Figure 3:
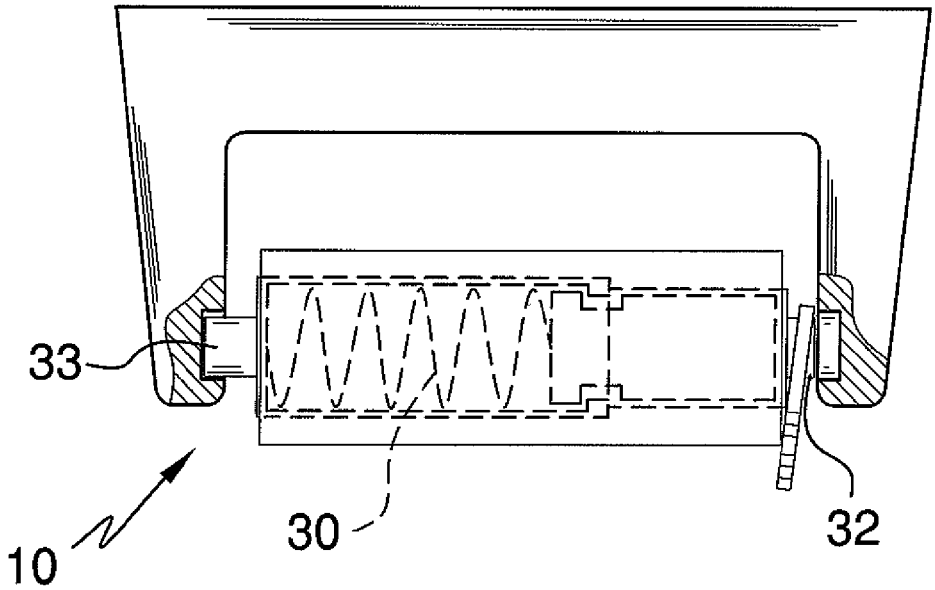
FIG. 3 is a top view of the present invention.

With reference now to the drawings, and in particular to FIGS. 1 through 4 thereof, a new toilet paper holder removal device embodying the principles and concepts of the present invention and generally designated by the reference numeral 10 will be described.

As best illustrated in FIGS. 1 through 4, the toilet paper holder removal system and method 10 generally includes a toilet paper holder 12 configured for holding a toilet paper roll 14 and dispensing toilet paper from the toilet paper roll 14. The toilet paper holder 12 includes a pair of brackets 16. The brackets 16 are spaced from each other. The brackets 16 each have a well 18 extending therein. The wells 18 face each other and are axially aligned with each other. A cylinder 20 has a first end 22 and a second end 24. The cylinder 20 includes a first portion 26 slidably extendable into a second portion 28. A distance between the first 22 and second 24 ends may be selectively altered. The first end 22 is biased away from the second end 24 by a spring 30. A first nub 32 and a second nub 33 are provided. The first nub 32 is attached to the first end 22 and the second nub is attached to the second end 24. The first 32 and second 33 nubs extends outwardly away from an associated one of the first 22 and second 24 ends. Each of the first 32 and second 33 nubs is removably extended into one of the wells 18 to mount the cylinder 20 to the brackets 16. In general, the toilet paper holder 12 is conventional in structure and function.

A single grip is provided 34 and is configured to be removably positioned on the first nub 32 and to provide leverage when the first end 22 of the cylinder 20 is urged toward the second end 24 of the cylinder 20. The grip 34 includes a panel 36 having a first end 38 and a second end 40. A pair of loop 42 is attached to the first end 38 of the grip 34. The loop 42 lies in plane of the panel 36. The first nub 32 is extended through the loop 42 so that the grip 34 is mounted on the cylinder 20. The panel 36 may be used to urge the first 22 and second 24 ends of the cylinder 20 toward each other when the first 32 and second 33 nubs are positioned in or removed from one of the wells 18. The panel 36 has a length generally between 1 inch and 2 inches. The second end 40 of the panel 36 flares outwardly and includes a plurality of fingers 44.

Figure 4:
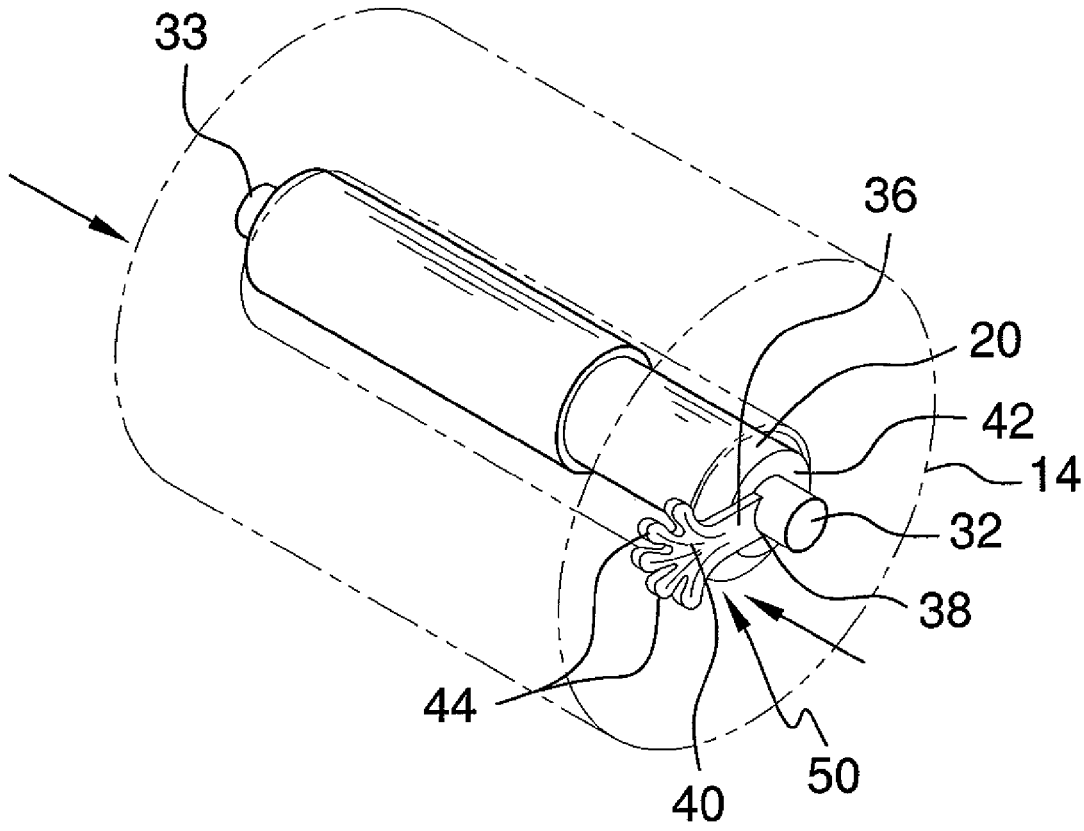
FIG. 4 is a front view of the present invention.

A second embodiment of the invention is found in FIG. 4 and includes a single grip 50 being integrally coupled to and non-removable from the first nub 32 to provide leverage when the first end 22 of the cylinder 20 is urged toward the second end 24 of the cylinder 20. The grip 50 of this embodiment includes a panel 36 that has a first end 38 and a second end 40 wherein the first end 38 is attached to the first nub 32. As with the previously discussed embodiment, the panel 36 may be used to urge the first end 22 of the cylinder 20 toward the second end 24 of the cylinder 20 when the first 32 and second 33 nubs are is positioned in or removed from the wells 18.

In use, the grip 34 is positioned on the cylinder 20 after a roll of toilet paper 14 is placed on the cylinder 20. The grip 34 allows a person to push the ends of the cylinder 20 inwardly without interference from the brackets so that the nubs 32 may be removed from the brackets 16.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A toilet paper holder removal system comprising:

a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a first nub and a second nub, said first nub being attached to said first end of said cylinder and said second nub being attached to said second end of said cylinder, said first and second nubs extending outwardly away from an associated one of said first and second ends, each of said first and second nubs being removably extended into one of said wells and mounting said cylinder to said brackets;

a single grip, said grip being removably positioned on said first nub to provide leverage when said first end of said cylinder is urged toward said second end of said cylinder, said grip includes a panel having a first end and a second end, a loop being attached to said first end of said grip, said first nub being extended through said loop to mount said grip on said on said cylinder, wherein said panel may be used to urge said first end of said cylinder toward said second end of said cylinder when said first and second nubs are being positioned in or removed from said wells, said loop lying in plane of said panel.

2. The system according to claim 1, wherein said panel has a length generally between 1 inch and 2 inches.

3. The system according to claim 1, wherein said second end of said panel flares outwardly and includes a plurality of fingers.

4. A toilet paper holder removal system comprising:

a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a first nub and a second nub, said first nub being attached to said first end of said cylinder and said second nub being attached to said second end of said cylinder, said first and second nubs extending outwardly away from an associated one of said first and second ends, each of said first and second nubs being removably extended into one of said wells and mounting said cylinder to said brackets;

a single grip, said grip being integrally coupled to and non-removable from said first nub to provide leverage when said first end of said cylinder is urged toward said second end of said cylinder, said grip includes a panel having a first end and a second end, said first end being attached to said first nub, wherein said panel may be used to urge said first end of said cylinder toward said second end of said cylinder when said first and second nubs are being positioned in or removed from said wells, said panel lying in a plane oriented perpendicular to a longitudinal axis of said cylinder, said panel having a length generally between 1 inch and 2 inches, said second end of said panel flares outwardly and includes a plurality of fingers.

5. A method of removing a toilet paper holder comprising the steps of:

providing a toilet paper holder configured for holding a toilet paper roll and dispensing toilet paper from the toilet paper roll, said toilet paper holder including;

a pair of brackets, said brackets being spaced from each other, said brackets each having a well extending therein, said wells facing each other and being axially aligned with each other;

a cylinder having a first end and a second end, said cylinder including a first portion slidably extendable into a second portion, wherein a distance between said first and second ends may be selectively altered, said first end being biased away from said second end;

a first nub and a second nub, said first nub being attached to said first end of said cylinder and said second nub being attached to said second end of said cylinder, said first and second nubs extending outwardly away from an associated one of said first and second ends, each of said first and second nubs being removably extended into one of said wells and mounting said cylinder to said brackets;

providing a single grip, said grip being removably positioned on said first nub to provide leverage when said first end of said cylinder is urged toward said second end of said cylinder, said grip includes a panel having a first end and a second end, a loop being attached to said first end of said grip, said first nub being extended through said loop to mount said grip on said on said cylinder, said loop lying in a same plane as said panel; and urging said panel toward said second end of said cylinder when said first and second nubs are being positioned in or removed from said wells.

6. The method according to claim 5, wherein the step of providing said grip further includes providing said second end being flared and including a plurality of fingers extending outwardly from said second end.

* * * * *